US005267593A

United States Patent [19]

Patterson

[11] Patent Number: 5,267,593

[45] Date of Patent: Dec. 7, 1993

[54] ROUTER SPINDLE ADAPTER APPARATUS

[76] Inventor: Arlin V. Patterson, 21 Wadsworth St., SW., Wyoming, Mich. 49548

[21] Appl. No.: 973,653

[22] Filed: Nov. 9, 1992

[51] Int. Cl.[5] ..... B27C 5/00

[52] U.S. Cl. ..... 144/134 A; 144/134 R; 144/134 D; 144/136 C; 144/218; 144/240

[58] Field of Search ..... 144/2 R, 134 R, 134 A, 144/134 D, 136 R, 136 C, 137, 218, 240, 241

[56] References Cited

U.S. PATENT DOCUMENTS

| | | | |
|---|---|---|---|
| 2,582,573 | 1/1952 | Gunten | 144/134 A |
| 2,776,682 | 1/1957 | Mullen | 144/134 A |
| 4,844,135 | 7/1989 | Witt | 144/240 |
| 4,942,912 | 7/1990 | Gakhar et al. | 144/136 C |
| 5,116,166 | 5/1992 | Rinas | 144/240 |

*Primary Examiner*—W. Donald Bray
*Attorney, Agent, or Firm*—Leon Gilden

[57] ABSTRACT

A spindle arranged for mounting shaper cutters to an associated router is configured to include a lower shaft coaxially aligned with an upper shaft having an abutment collar therebetween. An upper threaded boss mounts a fastener assembly to secure and position the shaper cutter between the abutment collar and the upper shaft threaded boss.

3 Claims, 4 Drawing Sheets

ROUTER SPINDLE ADAPTER APPARATUS

BACKGROUND OF THE INVENTION

1. Field of the Invention

The field of invention relates to router apparatus, and more particularly pertains to a new and improved router spindle adapter apparatus wherein the same is arranged to accommodate shaper cutters to a conventional router.

2. Description of the Prior Art

Routers of typical use by individuals are substantially of a three-horse power type having a half inch collet construction. The use of shaper cutters is typically accommodated by routers of increased size and cost. The instant invention permits the adapting of a shaper cutter relative to a conventional portable router structure. U.S. Pat. No. 4,942,912 to Gakhar, et al. sets forth the configuration of a typical below-the-table router apparatus, incorporated herein by reference.

The present invention provides a router spindle adapter apparatus wherein the same is arranged to accommodate shaper cutters in a manner not addressed by the prior art and in this respect, the present invention substantially fulfills this need.

SUMMARY OF THE INVENTION

In view of the foregoing disadvantages inherent in the known types of router apparatus now present in the prior art, the present invention provides a router spindle adapter apparatus wherein the same is arranged to accommodate shaper cutters relative to a router structure. As such, the general purpose of the present invention, which will be described subsequently in greater detail, is to provide a new and improved router spindle adapter apparatus which has all the advantages of the prior art router apparatus and none of the disadvantages.

To attain this, the present invention provides a spindle arranged for mounting shaper cutters to an associated router and configured to include a lower shaft coaxially aligned with an upper shaft having an abutment collar therebetween. An upper threaded boss mounts a fastener assembly to secure and position the shaper cutter between the abutment collar and the upper shaft threaded boss.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved router spindle adapter apparatus which has all the advantages of the prior art router apparatus and none of the disadvantages.

It is another object of the present invention to provide a new and improved router spindle adapter apparatus which may be easily and efficiently manufactured and marketed.

It is a further object of the present invention to provide a new and improved router spindle adapter apparatus which is of a durable and reliable construction.

An even further object of the present invention is to provide a new and improved router spindle adapter apparatus which is susceptible of a low cost of manufacture with regard to both materials and labor, and which accordingly is then susceptible of low prices of sale to the consuming public, thereby making such router spindle adapter apparatus economically available to the buying public.

Still yet another object of the present invention is to provide a new and improved router spindle adapter apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
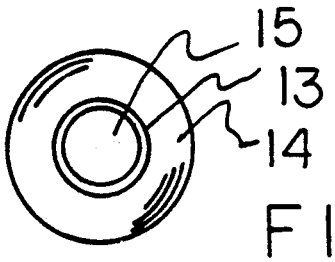
FIG. 2 is an orthographic top view of the shaft structure as set forth in FIG. 1.
Figure 1:
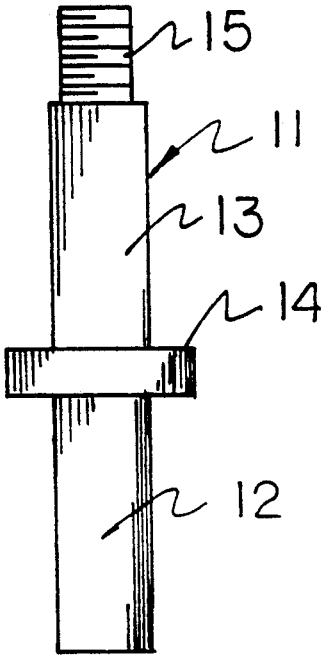
FIG. 1 is an orthographic view of the shaft structure of the invention.
Figure 4:
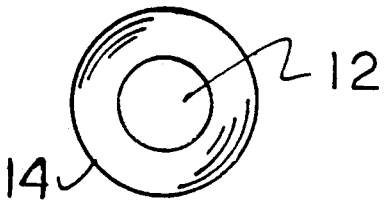
FIG. 4 is an orthographic bottom view of the shaft structure as set forth in FIG. 1.
Figure 5:
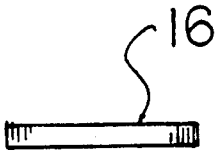
FIG. 5 is an orthographic side view of the washer ring as set forth in FIG. 3.
Figure 3:
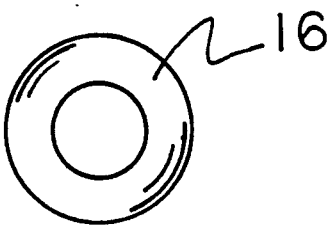
FIG. 3 is an orthographic view of a washer ring utilized by the invention.

With reference now to the drawings, and in particular to FIGS. 1 to 11 thereof, a new and improved router spindle adapter apparatus embodying the principles and concepts of the present invention and generally designated by the reference numeral 10 will be described.

Figures 6, 7:
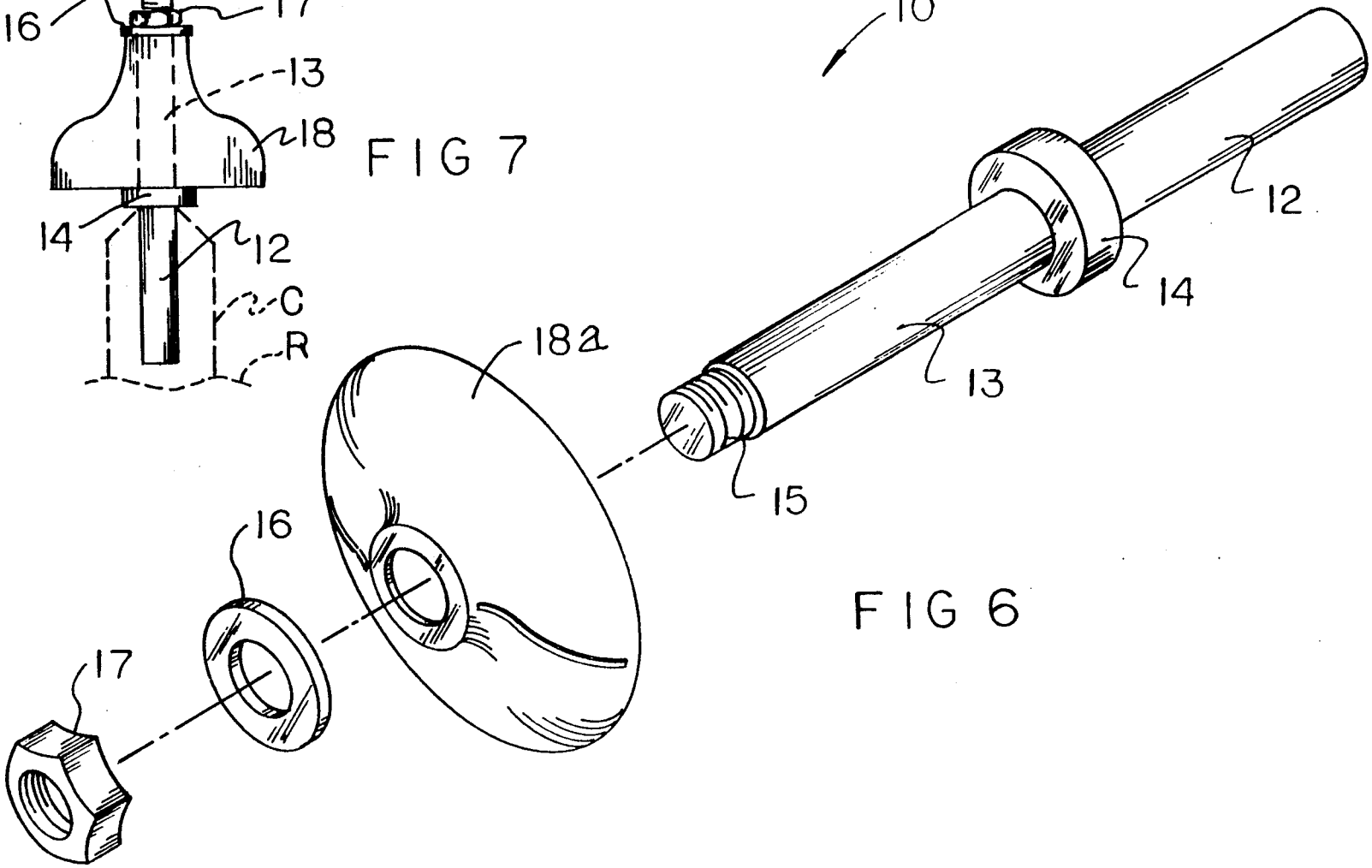
FIG. 6 is an isometric exploded view of the invention.
FIG. 7 is an orthographic view of the invention mounting a shaper cutter thereon.

More specifically, the router spindle adapter apparatus 10 of the instant invention essentially comprises an elongate shaft 11 having a lower shaft 12 for reception within a router chuck "C" of an associated router "R", in a manner as indicated in FIG. 7, with an abutment collar 14 mounted medially and orthogonally between the upper and lower shaft fixedly to the shaft 11. The shaft 11 is of a nominal one-half inch diameter, with the lower shaft of a length substantially equal to one and three-eighths inches, with the upper shaft 13 of a further length equal to one and nineteen-sixty-fourths. The upper shaft length is of a predetermined dimension to accommodate a rotary cutter 18, typically known as a "delta shaper cutter" that are employed in router structure of industrial sizes.

The upper shaft has an upper shaft threaded boss 15 coaxially aligned with the upper shaft to accommodate a washer ring 16 upon the upper shaft shoulder 20 to secure the cutter 18 between a washer ring 16 received on the shaft shoulder 20 and the abutment collar 14. A fastener nut 17 is thereafter secured about the threaded boss 15, with the organization mounted to the router "R", in a manner as indicated in FIG. 7. Typically, such router cutters are of an under table design, such as indicated in U.S. Pat. 4,942,912 incorporated herein by reference.

Figure 8:
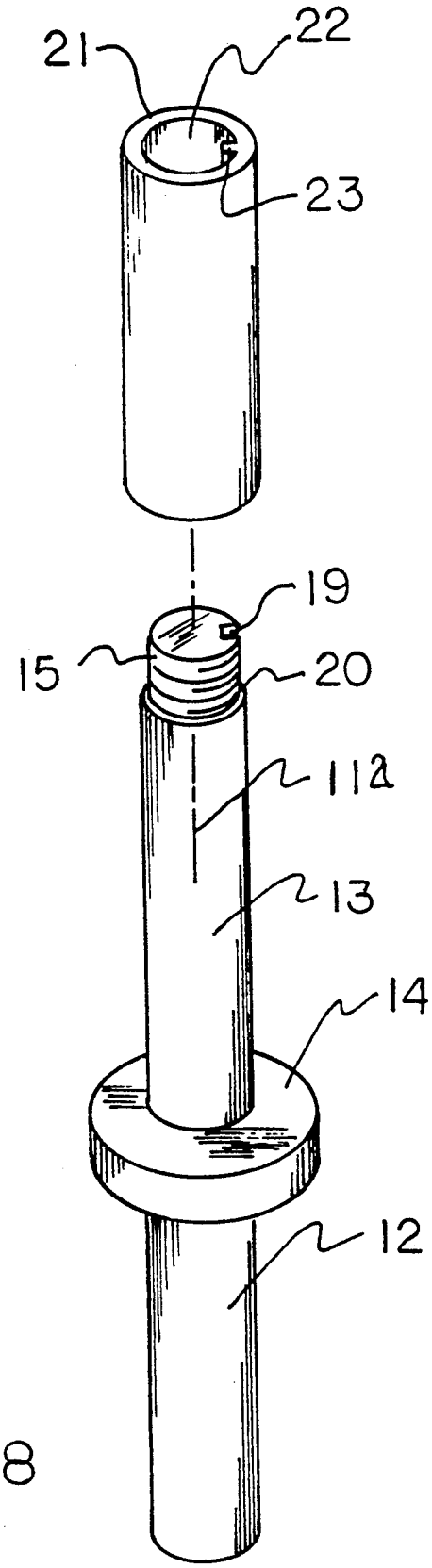
Fig. 8 is an isometric exploded view of a modified aspect of the invention employing a first adapter sleeve.
Figure 9:
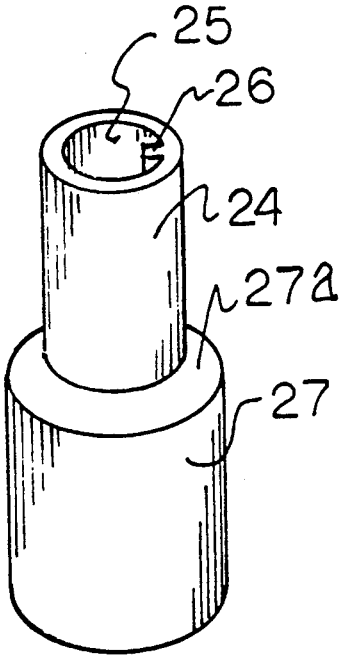
FIG. 9 is an isometric further sleeve structure.
Figure 10:
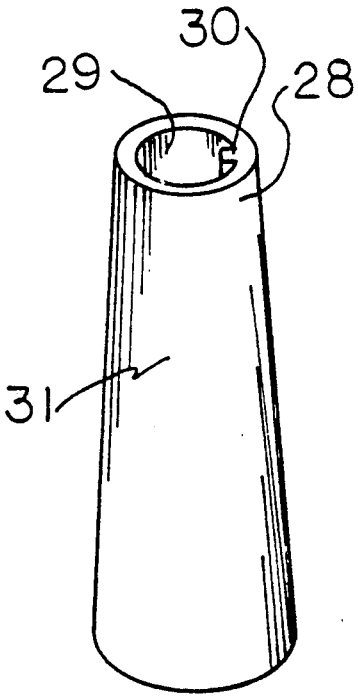
FIG. 10 is an isometric illustration of a third adapter sleeve structure employed by the invention.

The FIGS. 8, 9, and 10 indicate the use of adapter sleeves employed by the invention to accommodate cutters having enlarged bore diameters, wherein a groove 19 parallel to the axis 11*a* of the shaft 11 is arranged to direct the groove 19 peripherally along the upper shaft threaded boss 15. A first tubular sleeve 21 includes a first tubular sleeve bore 22 having a first rib 23 within the first sleeve bore 22 complementarily received within the groove 19. It should be noted that the groove 19 extends coextensively along, not only the upper shaft threaded boss 15, but the upper shaft 13 as well extending to the collar 14 to receive the sleeve 21 along and coextensively about the upper shaft 13. If desired, a stepped second sleeve structure may be employed, such as indicated in FIG. 9, having a second tubular sleeve 24, including a lower sleeve cylindrical shank 27 extending radially beyond the second tubular sleeve 24 defining a sleeve abutment ledge 27*a* to a position a cutter in an extended orientation relative to and spaced with the collar 14. The second sleeve bore 25, as well as the second sleeve rib 26, cooperate with the upper shaft 13, in a manner as described above. Similarly, FIG. 10 indicates a conical third tubular sleeve 28 having a conical outer wall 31, with the third sleeve bore 29 and the third sleeve rib 30 arranged for complementary reception about the upper shaft 13 to provide for a tapered interference fit with a cutter mounted and directed onto the third sleeve.

Figure 11:
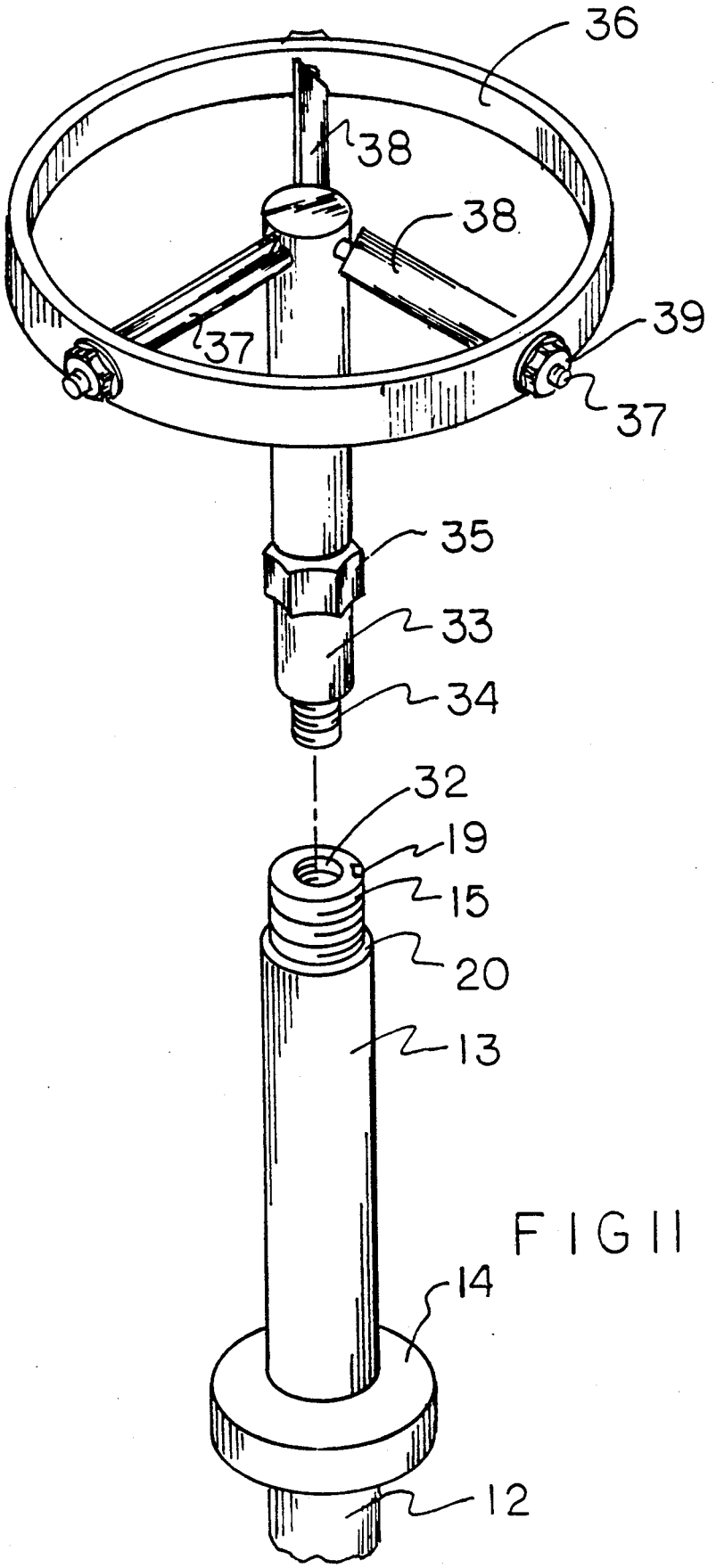
FIG. 11 is an isometric view of the invention employing a sawdust dispersing attachment.

The FIG. 11 indicates the use of the organization having a boss bore 32 internally threaded directed coaxially into the upper shaft threaded boss 15 to receive an extension shank threaded rod 34 of an extension shank 33 having a parallelepiped portion 35 to receive a wrench thereabout for securement of the extension shank 33 to the upper shaft 13. A cylindrical ring 36 is mounted concentrically and radially beyond the extension shank 33 having support rods 37 projecting radially from the extension shank to the cylindrical ring 36. Each of the support rods 37 includes a blade 38 mounted thereon that is rotatable about the rod 37 by means of a fastener member 39 secured to each support rod 37 exteriorly of the cylindrical ring 36. In this manner, rotation of the blades may be provided to provide for fanning of underlying sawdust when the cutter blade structure is arranged to project through a workpiece (not shown).

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A router spindle adapter apparatus in combination with a router having a router chuck, wherein the apparatus includes an elongate shaft having a lower shaft and an upper shaft, with an abutment collar mounted intermediate the lower shaft and the upper shaft at an interface of the lower shaft and the upper shaft, and wherein the upper shaft includes an upper shaft threaded boss, and a rotary cutter mounted on the upper shaft, and the upper shaft including an upper shaft shoulder about the threaded boss with the elongate shaft symmetrically oriented about a shaft axis, and the upper shaft shoulder orthogonally oriented relative to the shaft axis, and a washer ring received on the upper shaft shoulder, and a fastener nut secured about the upper shaft threaded boss in contiguous communication with the fastener nut fixedly securing the rotary cutter between the washer ring and the abutment collar, and the lower shaft extends a first length and the upper shaft extends a second length, and wherein the second length is less than the first length.

2. An apparatus as set forth in claim 1 including a tubular sleeve, wherein the tubular sleeve is oriented along a sleeve length equal to the second length, and wherein the upper shaft and the upper shaft threaded boss include a groove extending peripherally along the upper shaft threaded boss and the upper shaft parallel to the axis, and the sleeve having a sleeve bore, and the sleeve bore complementarily received about the upper shaft, and the sleeve bore including a rib extending into the bore, and the rib complementarily received within the groove.

3. An apparatus as set forth in claim 2 wherein the upper shaft threaded boss includes an internally threaded boss bore, and further including a cylindrical extension shank having a threaded rod coaxially aligned relative to the cylindrical extension shank, with the threaded rod received within the boss bore, and a parallelepiped portion integrally formed to the extension shank permitting accommodating of a tool member thereabout, with a cylindrical ring positioned concentrically and readily beyond the extension shank, with the cylindrical ring having a plurality of radial support rods extending from the extension shank to the cylindrical ring, the support rods are rotatably mounted relative to the extension shank, with the support rods each including a fastener member to fixedly secure each support rod relative to the cylindrical ring and the extension shank, with each support rod having a blade member coextensive along the support rod between the extension shank and the cylindrical ring.

* * * * *